US011858728B2

(12) United States Patent
Carrington

(10) Patent No.: US 11,858,728 B2
(45) Date of Patent: Jan. 2, 2024

(54) CONTAINER ANCHORING BASE

(71) Applicant: Scott Carrington, Calgary (CA)

(72) Inventor: Scott Carrington, Calgary (CA)

( * ) Notice: Subject to any disclaimer, the term of this patent is extended or adjusted under 35 U.S.C. 154(b) by 0 days.

(21) Appl. No.: 17/515,101

(22) Filed: Oct. 29, 2021

(65) Prior Publication Data

US 2023/0134069 A1 May 4, 2023

(51) Int. Cl.
*B65D 90/14* (2006.01)
*B65D 88/12* (2006.01)

(52) U.S. Cl.
CPC ..... *B65D 90/146* (2013.01); *B65D 88/129* (2013.01)

(58) Field of Classification Search
CPC ..... B65D 88/04; B65D 88/06; B65D 88/08; B65D 88/10; B65D 88/12; B65D 90/146; B65D 88/129; B65D 88/121; B65D 88/122; B65D 88/123; B65D 88/124; B65D 88/125; B65D 88/126; B65D 88/127; B65D 88/128; B65D 90/0026
See application file for complete search history.

(56) References Cited

U.S. PATENT DOCUMENTS 2,278,885 A 4/1942 Kuhl
3,753,272 A 8/1973 Laidley
3,985,231 A * 10/1976 Farhat ..... B65D 85/48 206/451
4,000,704 A 1/1977 Griffin, Jr.
4,641,399 A * 2/1987 Jackson ..... B65D 90/0006 410/82
4,644,708 A * 2/1987 Baudot ..... E04B 1/3483 52/79.9
4,697,458 A * 10/1987 Billstein ..... G01M 99/00 73/862
4,854,094 A * 8/1989 Clark ..... E04B 1/3483 52/234
8,534,969 B2 9/2013 Guo et al.
10,577,174 B2 3/2020 Fenneman et al.
10,689,840 B2 6/2020 Bonlin
11,248,351 B1 * 2/2022 Johnson ..... E01F 13/123
2001/0042697 A1 * 11/2001 Yajima ..... H01L 21/67369 211/41.18
2002/0007602 A1 1/2002 Corcoran
2003/0038054 A1 * 2/2003 Hurley ..... B65D 81/056 206/453
2004/0000645 A1 * 1/2004 Ramsden ..... G01T 1/20 250/361 R
2004/0188446 A1 * 9/2004 Gulati ..... F17C 3/00 220/651
2007/0194019 A1 * 8/2007 Seagle ..... B65D 19/18 340/572.1

(Continued)

FOREIGN PATENT DOCUMENTS

AU 2013201792 10/2013
AU 2020100492 5/2020

*Primary Examiner* — Kareen K Thomas
(74) *Attorney, Agent, or Firm* — Richard D. Okimaw

(57) ABSTRACT

A shipping container supporting assembly comprises a base member having a top surface and a width greater than 8 feet and a top surface and at least one connector extending from the top surface positioned and selected to be engagable within a twistlock opening of the intermodal shipping container. The may extend past one of the at least one connectors to form a weight support platform. A kit may include the base member and at least one weight.

9 Claims, 3 Drawing Sheets

(56) References Cited

U.S. PATENT DOCUMENTS

2008/0107852 A1* 5/2008 Rubb ..... C08J 9/20
521/146
2022/0219348 A1* 7/2022 Sorkin ..... B21C 47/18

* cited by examiner

CONTAINER ANCHORING BASE

BACKGROUND

1. Technical Field

This disclosure relates generally to forming portable structures and in particular to a weighted support base for locating shipping containers.

2. Description of Related Art

Intermodal shipping containers are often utilized for form temporary or rapid structures at a variety of locations. Such locations may frequently be remote having little site preparation. Accordingly, the ground at such locations may be, soft, uneven, unlevel or a combination of these site conditions. Current practices in such locations is frequently to level the ground as much as possible before locating the shipping container in place. It will be appreciated that such site preparation may be expensive requiring specialized equipment and may also result in less than optimal surface preparation.

Other attempts have been made to provide blocks or other bodies under specific locations the shipping container such as the corners. However, it will be appreciated that such blocks are prone to miss placement or may be difficult to horizontally align.

Other difficulties with shipping containers at remote locations is that such containers may be subjected to increased wind loading due to their raised or exposed location. Such loading is exacerbated by any additional structures such as antenna, solar panels or the like that are secured to the containers. Current ground work or blocks add no stability to the shipping container to resist such wind loading.

SUMMARY OF THE DISCLOSURE

According to a first embodiment, there is disclosed an apparatus for supporting an intermodal shipping container comprising a base member having a top surface and a width greater than 8 feet and a top surface and at least one connector extending from the top surface positioned and selected to be engagable within a twistlock opening of the intermodal shipping container.

The apparatus may further comprise two connectors. The two connectors may be spaced apart by a distance corresponding to a distance between twistlock openings on opposite sides of the shipping container. The at least one connector ay comprise a rotating connector.

The base member may extend past one of the at least one connectors to form a weight support platform. The weight support platform may extend past the at least one connector by a distance of at least 18 inches. The weight support platform may include a protrusion extending from the top surface sized to be received within a corresponding cavity in the bottom of a weight.

The base member may have a weight of at least 2000 pounds. The base member may be formed of concrete. The base member may include rebar therein. The base member may include openings therethrough proximate to a bottom thereof sized and positioned to receive forklift forks therein.

According to a further embodiment, there is disclosed a kit for forming a support for an intermodal shipping container comprising a base member having a top surface and a width greater than 8 feet and a top surface and at least one connector extending from the top surface positioned and selected to be engagable within a twistlock opening of the intermodal shipping container and at least one weight adapted to be located on an extension from the base member.

According to a further embodiment, there is disclosed a method for supporting an intermodal shipping container comprising locating a base member having a top surface and a width greater than 8 feet and a top surface at a desired location and positioning the shipping container on the base such that at least one twistlock opening of the shipping container is located around a corresponding connector extending from the top surface of the base member and securing the shipping container to the base member by locking the at least one connector.

The method may further comprise locating a weight on a weight supporting platform extending from the base member.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
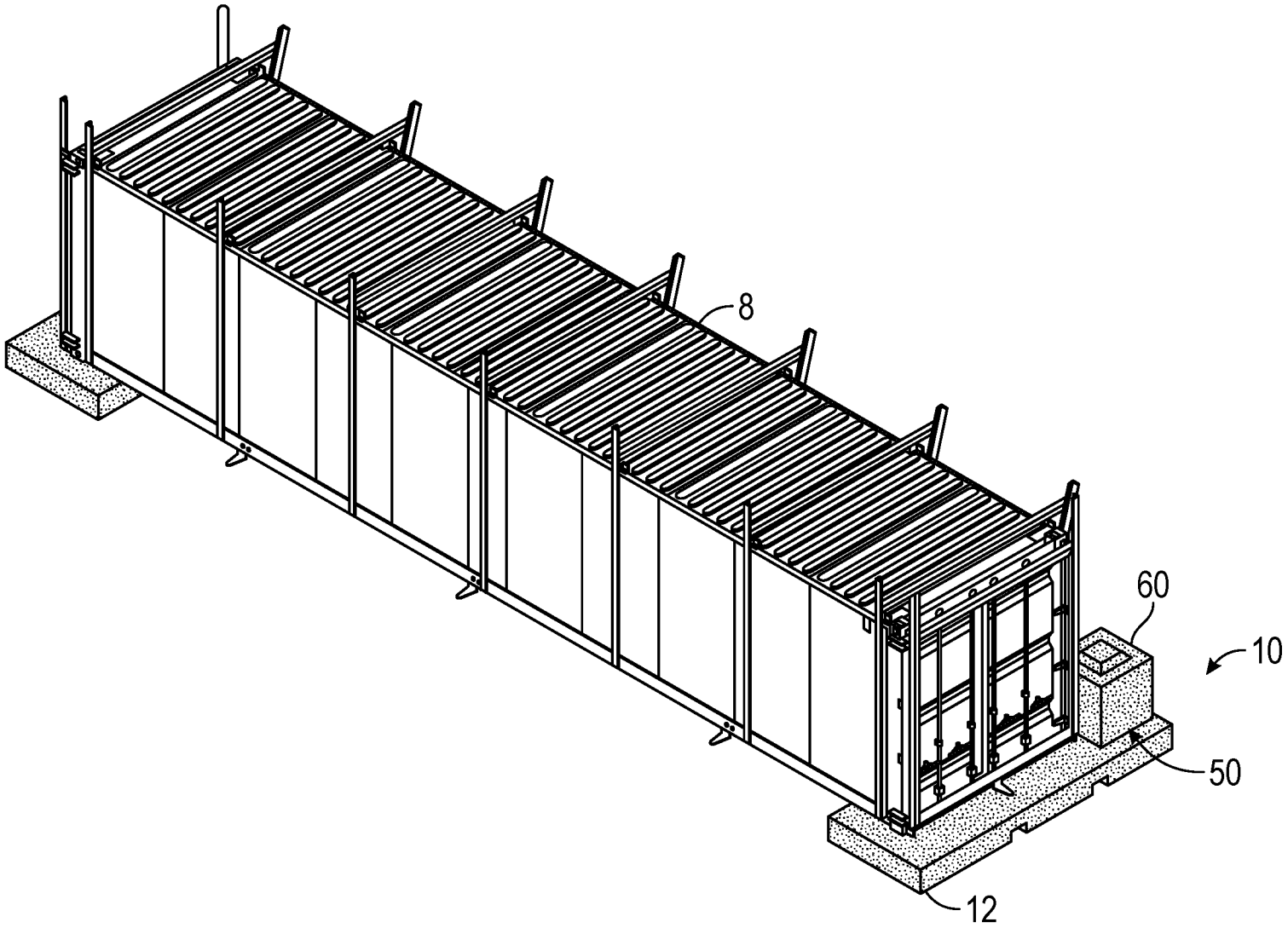
FIG. 1 is a perspective view of an intermodal shipping container located on the anchor base of the present disclosure.

Aspects of the present disclosure are now described with reference to exemplary apparatuses, methods and systems. Referring to FIG. 1, an exemplary apparatus for supporting an intermodal shipping container 8 according to a first embodiment is shown generally at 10. The apparatus 10 comprises a base 12 having at least one connector 40 extending from a top surface thereof adapted to engage with and secure the container 8 to the base 12.

Figure 2:
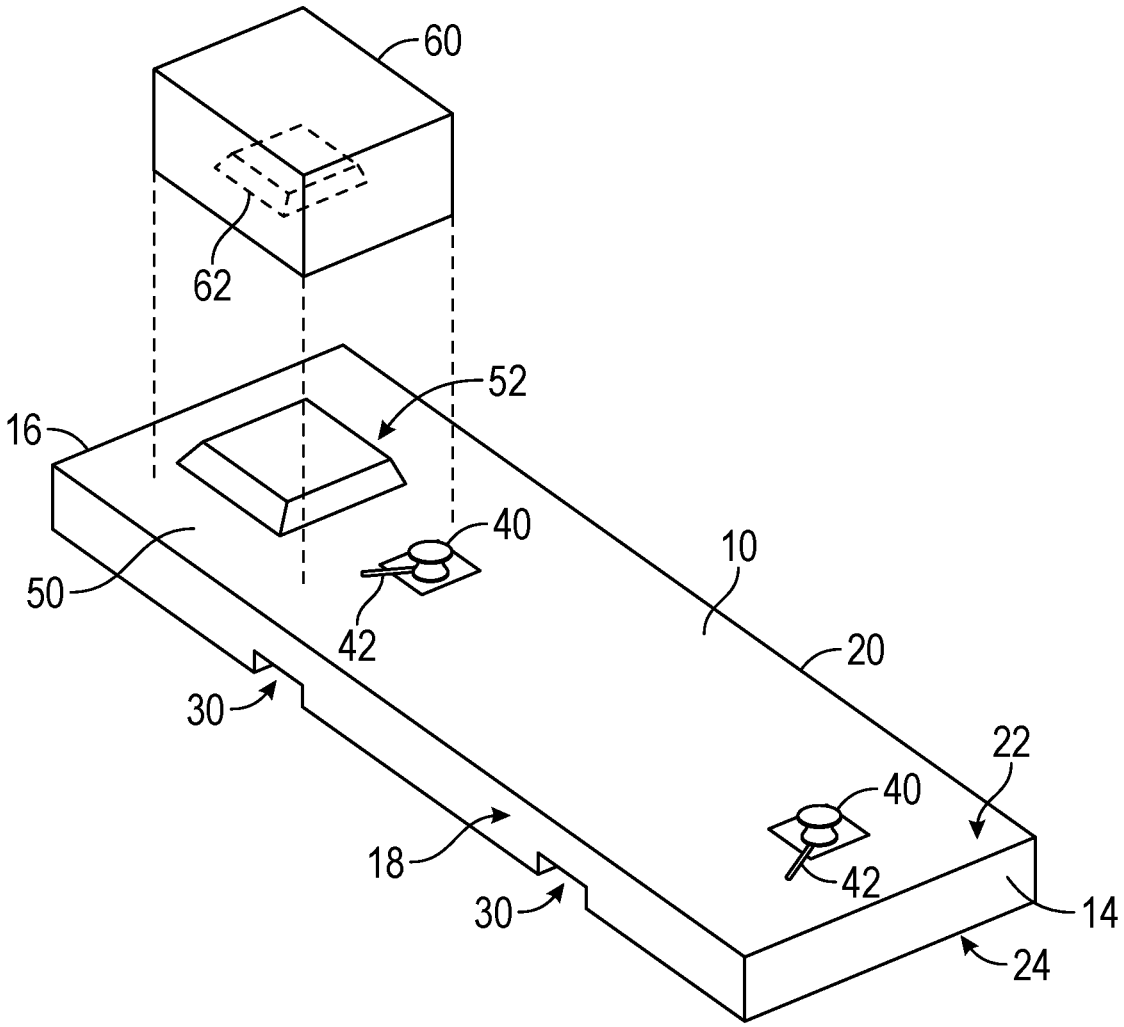
FIG. 2 is a perspective view of the anchor base of FIG. 1.
Figure 3:
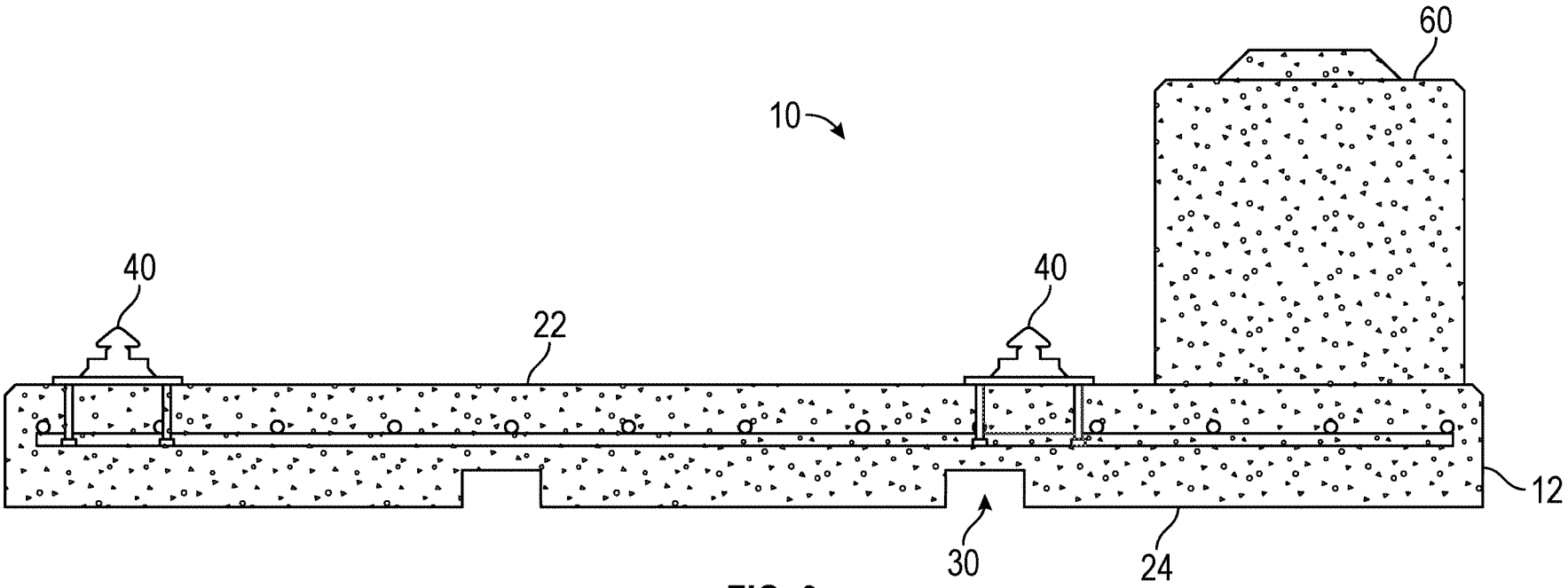
FIG. 3 is a side view of the anchor base of FIG. 1.

With reference to FIG. 2, the base 12 comprises a body of material selected to have dimensions and a shape sufficient to span an end of the intermodal shipping container as illustrated in FIG. 1. In particular, the base 12 extends between first and second ends, 14 and 16, respectively defining a length and first and second sides, 18 and 20 respectively defining a width. The base may have a thickness between top and bottom surfaces, 22 and 24, respectively selected to have sufficient strength to support the shipping container thereon without undesirable levels of flexing. In practice it has been found that a width between the first and second sides of between 1 and 5 feet (25 and 1524 mm), a length between the first and second ends of at least 8 feet (2400 mm) and a thickness of at least 6 inches (152 mm) has been adequate although it will be appreciated that other dimensions may be useful as well. It will be appreciated that in order to adequately stabilize the container from tipping, that larger dimensions will generally be more suitable, especially for larger shipping containers. The base 12 may be formed of any suitable material having sufficient strength and providing an adequate weight to stabilize the shipping container. In particular, it has been found that concrete has been particularly useful including rebar reinforced concrete. It will also be appreciated that steel or composite materials may be utilized provided sufficient weight is contained therein or thereon so as to sufficiently stabilize the container. In practice, it has been found that a weight of at least 2000 pounds has been useful. It will be appreciated that where other materials than concrete are utilized, that the above dimensions may be modified to accommodate the different density and strength characteristics of that material.

The top surface 22 includes at least one connector 40 extending therefrom. The connectors are located at a position to correspond to an opening in a bottom of the container 8 as are commonly included at the corners thereof. In particular, twist lock style connectors as are commonly utilized for securing such containers may be utilized within includes a rotatable oval body that is received within the oval shaped openings of the container and are thereafter rotated out of alignment with the openings to couple the container to the base. As illustrated in FIG. 2, two connectors may be utilized and spaced apart by a distance corresponding to the two openings on an end of the container. Once thus secured, the container will therefore be prevented from rotating independently of the base thereby adding the weight of the base to the overall structure and increasing the stability of the container. As illustrated in FIG. 2, the connectors may include a handle 42 for rotating and engaging the locks within the openings as are commonly known.

As illustrated in FIGS. 1 and 2, the base member 12 may include an extended weight platform 50 extending past one of the connectors 40 to the side of the base member 12. The weight platform 50 is positioned to extend past the side of the container 8 located thereon such that a weight 60 may be added to the top of the base member further increasing the weight thereof and therefore the overall stability of the container. The weight platform 50 may extend to the side of the container 8 by a distance of at least 24 inches (610 mm) although it will be appreciated that other distances may also be utilized depending on the weight type and dimensions. The weight 60 may be of any suitable size and type such as, by way of non-limiting example, concrete blocks, steel bodies or hollow containers adapted to be filled with a fluid. In particular, as illustrated in FIG. 2, the weight may comprise a concrete block having a cavity 62 in the bottom surface thereof as are commonly known. The weight platform 50 may include a corresponding protrusion extending from the top surface thereof adapted to be received the cavity 62 of the weight 60 thereon. The weight 60 may also include a protrusion on the top surface thereof to permit further stacking of additional weights.

In operation, at a desired location, the base may be located at the desired position for the container. As illustrated in FIG. 1, the assembly includes a base 12 at each end of the container although it will be appreciated that a single base may also be utilized. Once located at the desired position, the container 8 is then lowered onto the bases such that the openings in the bottom thereof are positioned around the connectors 40. The connectors may then be locked securing the container to the base. Optionally, one or more weights 60 may be positioned on the weight platform 50 either before or after the container is positioned on the bases. It will be appreciated that one or more of the bases 12 and or weights 60 may be transported to the desired location inside the container.

Optionally, the base may include at least one opening 30 therethrough for passing the forks of a forklift to be utilized during locating of the base at the desired location. As illustrated in FIG. 2, the openings 30 extend into the bottom 24 of the base 12 however they may also form bores into the middle of the base. Alternatively, lifting loops, handles or similar structures may be provided to assist lifting the base members 12.

Furthermore, it will be appreciated that the base member 12 may be formed at a desired location by pouring concrete into a form with the connectors 40 embedded therein. Such a poured base member 12 or other base members may also be formed to support the shipping container with a single base member 12.

While specific embodiments have been described and illustrated, such embodiments should be considered illustrative only and not as limiting the disclosure as construed in accordance with the accompanying claims.

What is claimed is:

1. An apparatus for supporting an intermodal shipping container comprising:

a base member having a top surface and a width greater than 8 feet so as to span greater than a width of an intermodal container located thereon; and at least two connectors extending from the top surface positioned and selected to be engagable within a pair of twistlock openings located on opposed sides of the intermodal shipping container.

2. The apparatus of claim 1 wherein the at least two connectors comprise rotating connectors.

3. The apparatus of claim 1 wherein the base member extends past one of the at least two connectors to form a weight support platform.

4. The apparatus of claim 3 wherein the weight support platform extends past the at least two connectors by a distance of at least 18 inches.

5. The apparatus of claim 3 wherein the weight support platform includes a protrusion extending from the top surface sized to be received within a corresponding cavity in the bottom of a weight.

6. The apparatus of claim 1 wherein the base member has a weight of at least 2000 pounds.

7. The apparatus of claim 1 wherein the base member is formed of concrete.

8. The apparatus of claim 7 wherein the base member includes rebar therein.

9. The apparatus of claim 1 wherein the base member includes openings therethrough proximate to a bottom thereof sized and positioned to receive forklift forks therein.

* * * * *